US007438620B2

(12) United States Patent
Homma et al.

(10) Patent No.: US 7,438,620 B2
(45) Date of Patent: Oct. 21, 2008

(54) ARC TUBE OF DISCHARGE LAMP HAVING ELECTRODE ASSEMBLIES RECEIVING VACUUM HEAT TREATMENT AND METHOD OF MANUFACTURING OF ARC TUBE

(75) Inventors: Akira Homma, Shizuoka (JP); Takeshi Fukuyo, Shizuoka (JP); Michio Takagaki, Shizuoka (JP); Shinya Misonou, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 167 days.

(21) Appl. No.: 11/291,827

(22) Filed: Dec. 2, 2005

(65) Prior Publication Data

US 2006/0119264 A1 Jun. 8, 2006

(30) Foreign Application Priority Data

Dec. 2, 2004 (JP) ..... P. 2004-349481

(51) Int. Cl.
*H01J 9/00* (2006.01)
*H01J 17/20* (2006.01)

(52) U.S. Cl. ..... 445/26; 313/574

(58) Field of Classification Search ..... None
See application file for complete search history.

(56) References Cited

U.S. PATENT DOCUMENTS 5,905,340 A * 5/1999 Karlotski et al. ..... 313/633
2002/0135305 A1* 9/2002 Horiuchi et al. ..... 313/636

FOREIGN PATENT DOCUMENTS

| | | | |
|---|---|---|---|
| JP | 11-238488 A | | 8/1999 |
| JP | 11-307048 A | | 11/1999 |
| JP | 11-329350 A | | 11/1999 |
| JP | 2003-86136 A | | 3/2003 |
| JP | 2004-39323 A | | 5/2004 |
| WO | WO 2004-097892 A2 | * | 11/2004 |

* cited by examiner

*Primary Examiner*—Joseph L. Williams
*Assistant Examiner*—Britt Hanley
(74) *Attorney, Agent, or Firm*—Sughrue Mion, PLLC

(57) ABSTRACT

In an arc tube for discharge lamp, an electrode assembly is formed by integrally joining an electrode rod, a molybdenum foil, and a molybdenum lead wire. The electrode assembly is sealed into pinch seal portions located at both ends of a glass tube. The electrode assembly, before being pinch-sealed into the pinch seal portions, receives vacuum heat treatment at 200 to 800° C. Hereby, the water content of the assembly is adjusted to 10 ppm or less, and desirably to 3 ppm less and an oxide film attached to the surface of the electrode assembly is removed. Therefore, the quantity of impurity (water or gas) enclosed in the closed glass bulb is very small, so that it is possible to provide an arc tube in which the flicker is not produced, luminous flux of 3000 lm or more is obtained, and starting voltage can be lowered to about 15 kV.

9 Claims, 6 Drawing Sheets

(a1)
(CUTTING)
(b1)
VACUUM HEAT FURNACE
(b2)
OXIDATION · REDUCTION FURNACE
(a2)
(CUTTING)
(a3)
(CUTTING)
(b3)
REDUCTION FURNACE
(c)
(d)
VACUUM HEAT FURNACE
(e)
6
7
8
8a
A
A'

FIG. 4

RESULT LIFE MEASUREMENT TEST

| | n | ELAPSE OF LIFE TEST |
|---|---|---|
| NOT PROCESSED (COMPARATIVE EXAMPLE) | 5 | FLICKER IS PRODUCED AT 2560hr, 2570hr, AND 2670hr |
| VACUUM HEAT TREATMENT AT 200°C (EMBODIMENT 1) | 5 | FLICKER IS NOT PRODUCED WITHIN 3000hr |
| VACUUM HEAT TREATMENT AT 800°C (EMBODIMENT 2) | 5 | FLICKER IS NOT PRODUCED WITHIN 3000hr |
| VACUUM HEAT TREATMENT AT 1050°C | 5 | FOIL LIFTING IS PRODUCED WITHIN 1000hr (NO FLICKER) |

FIG. 5

RESULT OF LUMINOUS FLUX MEASUREMENT TEST

| | n | LUMINOUS FLUX (AVERAGE) |
|---|---|---|
| NOT PROCESSED (COMPARATIVE EXAMPLE) | 10 | 2976 lm |
| VACUUM HEAT TREATMENT AT 200°C (EMBODIMENT 1) | 10 | 3081 lm |
| VACUUM HEAT TREATMENT AT 800°C (EMBODIMENT 2) | 10 | 3110 lm |

FIG. 6

RESULT OF STARTING VOLTAGE MEASUREMENT TEST

| | n | STARTING VOLTAGE (AVERAGE) |
|---|---|---|
| NOT PROCESSED (COMPARATIVE EXAMPLE) | 10 | 18.9 kV |
| VACUUM HEAT TREATMENT AT 200°C (EMBODIMENT 1) | 10 | 15.4 kV |
| VACUUM HEAT TREATMENT AT 800°C (EMBODIMENT 2) | 10 | 15.0 kV |

ARC TUBE OF DISCHARGE LAMP HAVING ELECTRODE ASSEMBLIES RECEIVING VACUUM HEAT TREATMENT AND METHOD OF MANUFACTURING OF ARC TUBE

The present application claims foreign priority based on Japanese Patent Application No. P.2004-349481, filed on Dec. 2, 2004, the contents of which are incorporated herein by reference.

BACKGROUND OF THE INVENTION

1. Field of the Invention

The present invention relates to an arc tube of discharge lamp and a method of manufacturing an arc tube.

2. Related Art

FIG. 7 shows a discharge lamp of related art. A front end portion of an arc tube 5 is supported by a single lead support 2 that protrudes forward of an insulating base 1, and a rear end portion of the arc tube 5 is supported by a recess part 1*a* of a base 1, and further a rear-end-side portion of the arc tube 5 is gripped by a metallic support member S fixed to a front surface of the insulating base 1.

A front-end-side lead wire 8 that is led out from the arc tube 5 is fixed to the lead support 2 by welding, while a rear-end-side lead wire 8 is fixed, through a bottom wall 1*b* that forms the recess part 1*a* of the base 1, to a terminal 3 provided for the bottom wall 1*b* by welding. Reference character G is an ultraviolet shielding globe having the nearly cylindrical shape, which cuts ultraviolet component in a wavelength area that is harmful to the human body, of light emitted from the arc tube 5. This globe G is integrally welded to the arc tube 5.

The arc tube 5 is structured, as shown in FIG. 8, that a closed glass bulb 5*a* in which electrode rods 6, 6 are oppositely arranged and a light emitting substance (mercury or metal halogen) is enclosed, is formed between a pair of front and back pinch seal portions 5*b*, 5*b*. Into the pinch seal portions 5*b*, electrode assemblies A, A' are sealed thereby to secure air tightness in the closed glass bulb 5*a*. The electrode assembly is formed by integrally joining the tungsten electrode rod 6 that protrudes into the closed glass bulb 5*a* and a molybdenum lead wire 8 that leads out from the pinch seal portion 5*b* through a molybdenum foil 7.

As a method of manufacturing this arc tube (mercury enclosing arc tube) 5, firstly, as shown in FIG. 9(*a*), from a lower opening end side of a cylindrical glass tube W in which a glass bulb w2 is formed midway of a linear extension portion w1, the electrode assembly A formed by integrally joining the electrode rod 6, the molybdenum foil 7 and the lead wire 8 is inserted. Then, a position q1 near the chamber portion w2 is primarily pinch-sealed. Next, as shown in FIG. 9(*b*), through a mercury supply nozzle N inserted into the glass tube W from an upper opening end side, mercury is supplied into the glass bulb w2. Next, as shown in FIG. 9(*c*), into the glass bulb w2, pellet P of the light emitting substance is put. Next, as shown in FIG. 9(*d*), another electrode assembly A' having a bending part 8*a* at the lead wire 8 is inserted into the glass tube W and held by itself. Namely, the bending part 8*a* that is formed at the lead wire 8 and has the width larger than the inner diameter of the glass tube W comes into pressure-contact with the inner surface of the glass tube W, and by this pressure-contact power, the electrode assembly A' inserted into the glass tube W is held in the inserted position by itself. Next, the opening end of the glass tube W is temporarily sealed using a burner. Further, the electrode assembly A' inserted portion of the glass tube W is secondarily pinch-sealed, the temporarily sealed portion of the glass tube W is cut at the predetermined position, and the lead wire 8 is led out from the glass tube W.

It has been known that this kind of arc tube 5 has a problem of a phenomenon in which light flickers during lighting the arc tube (hereinafter, this phenomenon is referred to as flicker).

Mechanism of generation of this flicker is represented by the following reaction expressions:

$$4ScI_3+3SiO_2 \rightarrow 2Sc_2O_3+3SiI_4 \quad (1)$$

$$nW+SiI_4 \rightarrow SiWn+2I_2 \quad (2)$$

$$4ScI_3+3ThO_2 \rightarrow 2Sc_2O_3+3ThI_4 \quad (3)$$

This mechanism can be explained as follows.

Namely, as shown in the expression (1), vitreous silica ($SiO_2$) constituting the tube wall of the arc tube reacts with $ScI_3$, so that a devitrification phenomenon is produced. $SiI_4$ (Si in $SiI_4$) produced at this time, as shown in the expression (2), reacts with the tungsten electrode, so that low melting metal (SiWn) is produced. Further, in a thoriadoped tungsten electrode, as shown in the expression (3), thoria ($ThO_2$) disappears, the distance between the electrodes widens due to deformation and damage of the electrode, the restriking voltage increases, and a ballast becomes uncontrollable state, so that flicker occurs.

In the mechanism (reaction expressions) of occurrence of this flicker, in case that impure gas and water exist, the reaction is promoted more. Therefore, there have been proposals for preventing the occurrence of this flicker by lessening OH-group content in vitreous silica constituting the arc tube as disclosed in JP-A-11-329350, or by lessening water content in the enclosed substance (metal halide) in the closed glass bulb as disclosed in JP-A-2004-039323.

Further, in the closed glass bulb 5*a* of the conventional arc tube, mercury that performs buffer action is enclosed. The mercury is a harmful substance to environment. Correspondingly to social needs of reducing environmental pollution on the earth as much as possible, the development of a mercury-free arc tube that does not include mercury in the closed glass bulb 5*a* is being performed actively. A method of manufacturing this mercury-free arc tube, except for omission of the mercury supply step shown in FIG. 9(*b*) in the before-mentioned method of manufacturing the mercury including arc tube (refer to FIGS. 9(*a*) to 9(*d*)), is nearly the same as the method of manufacturing the mercury including arc tube.

However, it is insufficient for preventing the occurrence of flicker, by lessening the OH-group content in vitreous silica or lessening the water content in the pellet P of the enclosed substance (metal halide) as disclosed in JP-A-11-329350 and JP-A-2004-039323.

SUMMARY OF THE INVENTION

The inventors have founded during the development of this mercury-free arc tube that it is more important on prevention of the occurrence of flicker to remove impurity (water and oxide film) attached onto the electrode assembly than to lessen the OH-group content in vitreous silica or to lessen the water content in the pellet P of the enclosed substance (metal halide) as disclosed in JP-A-11-329350 and JP-A-2004-039323. Particularly, they have founded that it is effective for prevention of the occurrence of flicker to previously apply vacuum heat treatment to the electrode assemblies A, A' used in the pitch seal step at 200 to 800° C.

The total weight of the substance (metal halide) enclosed as the pellet P in the closed glass bulb 5*a* is 0.3-0.4 mg at the most, while the weight of each electrode assembly A, A' is about 75 mg (the total weight of the two assemblies is about 150 mg). Therefore, even if the pellet P and the electrode assembly A, A' have the same water content, the electrode assembly A, A' is much larger in total quantity of water. Therefore, the inventors have thought that it is effective for prevention of the occurrence of flicker to lessen the water content of the electrode assembly A, A'.

Further, in the conventional method of manufacturing the mercury-free arc tube, in order to prevent the impure gas and water from existing in the closed glass bulb 5*a*, to the electrode rod 6, the molybdenum foil 7, and the lead wire 8 that constitute the electrode assembly A, A', treatment for removing the impurity (water and oxide film) is applied on parts level (to the electrode rod 6, vacuum heat treatment is applied; to the molybdenum foil 7, oxidation×reduction treatment is applied; and to the lead wire 8, reduction treatment is applied). The inventors have performed evaluation tests on the manufactured mercury-free arc tube, resulting in that, as shown in each comparative example in FIGS. 4, 5, and 6, in a life test, the flicker occurs at 2560 to 2670 hours; in a luminous flux measurement test, the luminous flux (average) is 2976 lm, which is low; and in a starting voltage measurement test, the starting voltage (average) is 18.9 kV, which is high. Any tests have undesirable results.

The inventors have thought this reason as follows: though the impurity (water and oxide film) is removed from the electrode rod 6, the molybdenum foil 7, and the lead wire 8 once by the impurity (water and oxide film) removing treatment performed on the parts level, when the electrode rod 6, the molybdenum foil 7, and the lead wire 8 are thereafter welded (joined) in the air to be integrally formed as the electrode assembly A, A', the impurity (water and oxide film) is attached again to the electrode assembly A, A', so that the occurrence of flicker is promoted, or energy is used in excitation of the impurity, so that the luminous flux lowers or the starting voltage of the arc tube becomes high.

Therefore, in case that the inventors have applied the vacuum heat treatment to the electrode assemblies A, A' obtained by integrally forming the electrode rod 6, the molybdenum foil 7, and the lead wire 8 at 200 to 800° C. prior to the pinch seal step, the following desirable results as shown in embodiments 1 and 2 in FIGS. 4, 5, and 6 were obtained: in the life test, the flicker does not occur within 3000 hours; in the luminous flux measurement test, the luminous flux (average) of 3000 lm or more is obtained; and in the starting voltage measurement test, the starting voltage (average) lowers to about 15 kV. Therefore, the inventors have come to propose the invention.

One or more embodiments of the present invention provide an arc tube for discharge lamp and a method of manufacturing the arc tube in which flicker does not occur.

In accordance with one or more embodiments of the present invention, an arc tube of discharge lamp is provided with: a closed glass bulb in a center of a glass tube, wherein a light emitting substance and a starting rare gas is enclosed in the closed glass bulb; and electrode assemblies formed by integrally joining an electrode rod, a molybdenum foil, and a molybdenum lead wire and sealed into pinch seal portions at both ends of the closed glass bulb so as to oppositely arrange electrodes in the closed glass bulb, wherein the electrode assembly receives vacuum heat treatment at 200 to 800° C. before being sealed into the pinch seal portions. In the arc tube, water contents of the electrode assemblies before being sealed into the pinch seal portions may be 10 ppm or less. Further, In the arc tube, the water contents of the electrode assemblies before being sealed into the pinch seal portions may be 3 ppm or less.

In accordance with one or more embodiments of the present invention, a method of manufacturing an arc tube of discharge lamp comprises: a primary pinch seal step of inserting a first electrode assembly from one end of a glass tube and pinch-sealing the glass tube, wherein the first electrode assembly is formed by integrally joining an electrode rod, a molybdenum foil, and a molybdenum lead wire; a secondary pinch seal step of inserting a second electrode assembly from the other end of the glass tube and pinch-sealing the glass tube in a state where starting rare gas and a light emitting substance are supplied into the glass tube, wherein the second electrode assembly is formed by integrally joining an electrode rod, a molybdenum foil, and a molybdenum lead wire; and a step of applying a vacuum heat treatment to the first and second electrode assemblies at a temperature of 200 to 800° C., prior to the first and second pinch seal steps.

By applying the vacuum heat treatment at 200 to 800° C. to the electrode assembly before being sealed into the pinch seal potion, the water content of the electrode assembly is adjusted to 10 ppm or less, and desirably 3 ppm or less. Further, in a state where the oxide film attached on the surface of the electrode assembly (the oxide film mainly attached to each joint portion among the electrode rod, the molybdenum foil, and the molybdenum lead wire) is also surely removed, the electrode assembly is sealed (pinch-sealed) into the pinch seal portion.

Therefore, as indicated in the result of the life measurement test (refer to FIG. 4), in the comparative example, the flicker occurs at about 2600 hours, while the flicker does not occur within 3000 hours in the arc tube according to the embodiment of the present invention. Further, as indicated in the result of the luminous flux measurement test (refer to FIG. 5), in the comparative example, the luminous flux is 2976 lm that is smaller than 3000 lm that is a generally required standard as a luminous flux vale of a light source bulb for automotive head lamp, while the luminous flux (average) of 3000 lm or more is obtained in the arc tube according to the invention. Further, as indicated in the result of the starting voltage measurement test (refer to FIG. 6), in the comparative example, the starting voltage (average) is about 19 kV, which is a high value, while the starting voltage (average) in the arc tube according to the invention lowers to about 15 kV that is lower than 16 kV that is generally taken as desirable starting voltage.

As shown in these drawings of FIGS. 4 to 6, in order to prevent the occurrence of the flicker, it is proper that the temperature of the vacuum heat treatment applied to the electrode assembly is set to 200° C. or more and the water content of the electrode assembly is set to 10 ppm or less, and desirably 3 ppm or less. Further, as the temperature of the vacuum heat treatment becomes higher, the luminous flux value increases, and the starting voltage lowers. Therefore, it is desirable that the temperature of the vacuum heat treatment is high. However, in case that the temperature of the vacuum heat treatment is 800° C. or more, though the water content of the electrode assembly surely becomes 3 ppm or less, firstly, crystal particles of the molybdenum foil glow (enlarge), surface roughness of the molybdenum foil is flattened, and airtightness with the vitreous silica lowers, so that foil lifting that causes leak of the substance enclosed in the closed glass bulb (phenomenon in which a clearance is formed between the molybdenum foil and the glass layer) is produced. Secondarily, though the molybdenum lead wire of the second electrode assembly on the secondary pinch seal side has the bending part that comes into pressure-contact with the inner surface of the glass tube thereby to cause the electrode assembly to be held by itself in the predetermined position in the glass tube, tensile strength (spring power) of this lead wire (bending part) lowers at the vacuum heat treatment temperature of 800° C. or more, and the self-holding function of the lead wire bending part lowers in the secondary pinch seal, so that the second electrode assembly is difficult to be held in the predetermined position in the glass tube. Therefore, it is desirable that the vacuum heat treatment temperature of the electrode assembly is in a range of 200 to 800° C.

In addition, in one or more embodiments of the present invention, in the method of manufacturing the arc tube, a vacuum heat treatment at a temperature of 1600 to 2200° C. may be applied to the electrode rod, prior to integrally forming the electrode assemblies.

Since the electrode rod in the electrode assembly receives the impurity removing treatment twice, the quantity of the impurity (water and oxide film) attached to the electrode assembly is correspondingly small, and the quantity of water and gas as the impurity enclosed in the closed glass bulb is correspondingly small. Therefore, this treatment is effective for prevention of the occurrence of flicker.

Particularly, in the electrode rod that has received the vacuum heat treatment at the high temperature of 1600-2200° C., not only the water and the oxide film that are attached on the surface of the electrode rod but also impurity (water and foreign substance) inside the electrode rod can be removed. The higher this vacuum heat treatment temperature is, the higher the impurity (water and foreign substance) removal effect is. However, simultaneously, coarsening of the crystal progresses and the electrode rod becomes easy to bend. Therefore, it is desirable that the treatment temperature suited to the diameter of the electrode rod is selected (for example, in the electrode rod having the diameter of 0.25 mm, the treatment temperature is set to about 1600° C.).

In addition, in accordance with one or more embodiments of the present invention, in the method of manufacturing the arc tube, an oxidation treatment at a temperature of 300 to 500° C. may be applied to the molybdenum foil; and a reduction treatment at a temperature of 900° C. may be applied to the molybdenum foil after the oxidation treatment, prior to integrally forming the electrode assemblies.

Since the molybdenum foil in the electrode assembly receives the impurity removing treatment twice, the quantity of the impurity (water and oxide film) attached to the electrode assembly is correspondingly small, and the quantity of water and gas as the impurity enclosed in the closed glass bulb is correspondingly small. Therefore, this treatment is effective for prevention of the occurrence of flicker. Further, the oxidation/reduction treatment applied to the molybdenum foil before being integrally formed as the electrode assembly works so as to increase surface roughness of the molybdenum foil and increase air tightness with the glass layer.

In addition, in accordance with one or more embodiments of the present invention, in the method of manufacturing the arc tube, a reduction treatment at a temperature of 800° C. may be applied to the molybdenum lead wire, prior to integrally forming the electrode assemblies.

Since the molybdenum lead wire in the electrode assembly receives the impurity removing treatment twice, the quantity of the impurity (water and oxide film) attached to the electrode assembly is correspondingly small, and the quantity of water and gas as the impurity enclosed in the closed glass bulb is correspondingly small. Therefore, this treatment is effective for prevention of the occurrence of flicker.

In the arc tube for discharge lamp in accordance with one or more embodiments of the present invention, since the electrode assembly from which the impurity (water and oxide film) has been removed is sealed into the pinch seal portion, the quantity of the water or gas as the impurity enclosed in the closed glass bulb is small, so that the arc tube for discharge lamp in which the flicker does not occur is provided.

In the method of manufacturing the arc tube for discharge lamp in accordance with one or more embodiments of the present invention, since the glass tube is pinch-sealed in the state where the impurity (water and oxide film) has been removed from the electrode assembly, the quantity of the water or gas as the impurity enclosed in the closed glass bulb is small, so that the arc tube for discharge lamp in which the flicker does not occur is provided.

Moreover, in the method according to one or more embodiments of the present invention, since the impurity (water and oxide film) attached particularly onto the electrode rod of the electrode assembly has been surely removed, the quantity of the water or gas as the impurity enclosed in the closed glass bulb is correspondingly reduced, so that the arc tube for discharge lamp in which the flicker does not occur is provided.

Moreover, in the method according to one or more embodiments of the present invention, since the impurity (water and oxide film) attached particularly onto the molybdenum foil of the electrode assembly has been surely removed, the quantity of the water or gas as the impurity enclosed in the closed glass bulb is correspondingly reduced, so that the arc tube for discharge lamp in which the flicker does not occur is provided.

Moreover, in the method according to one or more embodiments of the present invention, since the impurity (water and oxide film) attached particularly onto the molybdenum lead wire of the electrode assembly has been surely removed, the quantity of the water or gas as the impurity enclosed in the closed glass bulb is correspondingly reduced, so that the arc tube for discharge lamp in which the flicker does not occur is provided.

Other aspects and advantages of the invention will be apparent from the following description and the appended claims.

BRIEF DESCRIPTION OF THE DRAWINGS

FIG. 3(*b*) is an explanatory view of a real pinch seal step in the primary pinch seal step.

FIG. 3(*c*) is an explanatory view of a putting-in step of a pellet of a light emitting substance.

FIG. 3(*d*) is an explanatory view of an insertion step of a second electrode assembly.

FIG. 3(*e*) is an explanatory view of a tip-off step (temporarily electrode assembly fixing step).

FIG. 3(*f*) is an explanatory view of a secondary pinch seal step.

FIG. 4 is a diagram showing a result of a life measurement test of the arc tube, compared with a comparative example.

FIG. 5 is a diagram showing a result of a luminous flux measurement test of the arc tube, compared with a comparative example.

FIG. 6 is a diagram showing a result of a starting voltage measurement test of the arc tube, compared with a comparative example.

FIG. 9(*b*) is an explanatory view for explaining the manufacturing process of the mercury arc tube of related art, in a mercury supplying step.

FIG. 9(*c*) is an explanatory view for explaining the manufacturing process of the mercury arc tube of related art, in a pellet putting step.

FIG. 9(*d*) is an explanatory view for explaining the manufacturing process of the mercury arc tube of related art, in a secondary pinch seal step.

DESCRIPTION OF THE PREFERRED EMBODIMENTS

Embodiments of the invention will be described with reference to the accompanying drawings.

Figure 1:
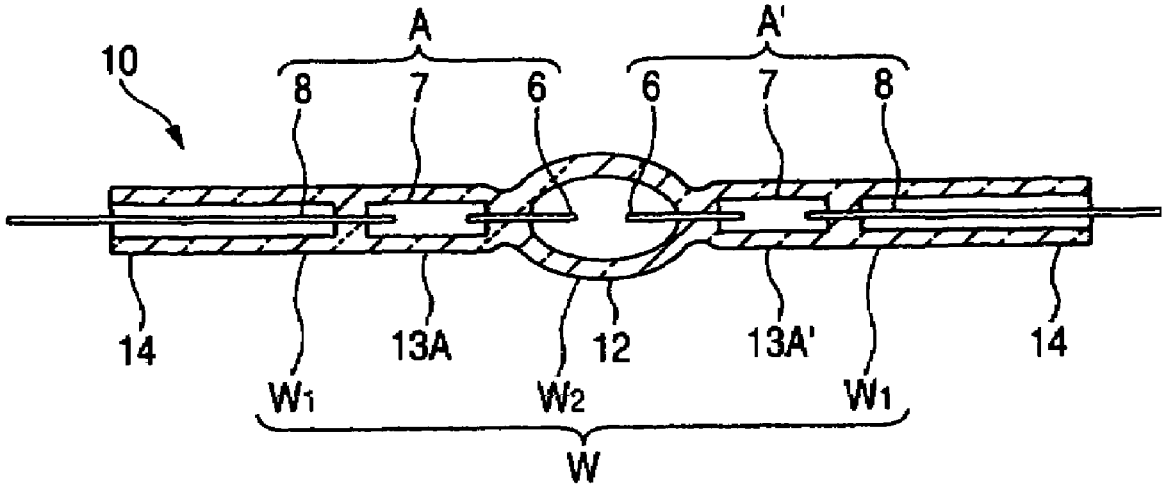
FIG. 1 is a longitudinal section of a mercury-free arc tube for discharge lamp in one embodiment of the invention.
Figure 2:
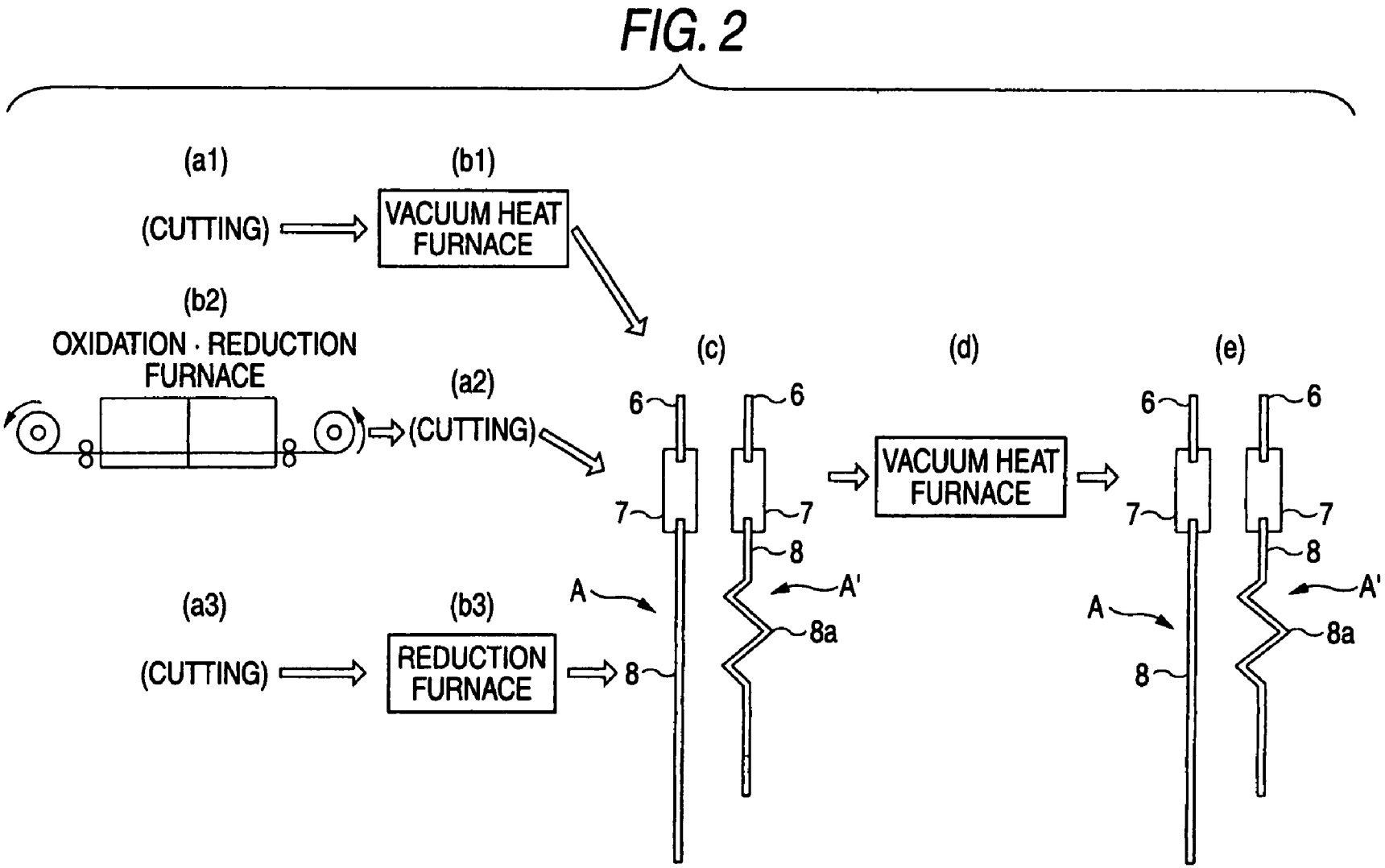
FIG. 2 is a process drawing that shows a pretreatment step in a manufacturing process of the arc tube.
Figure 3:
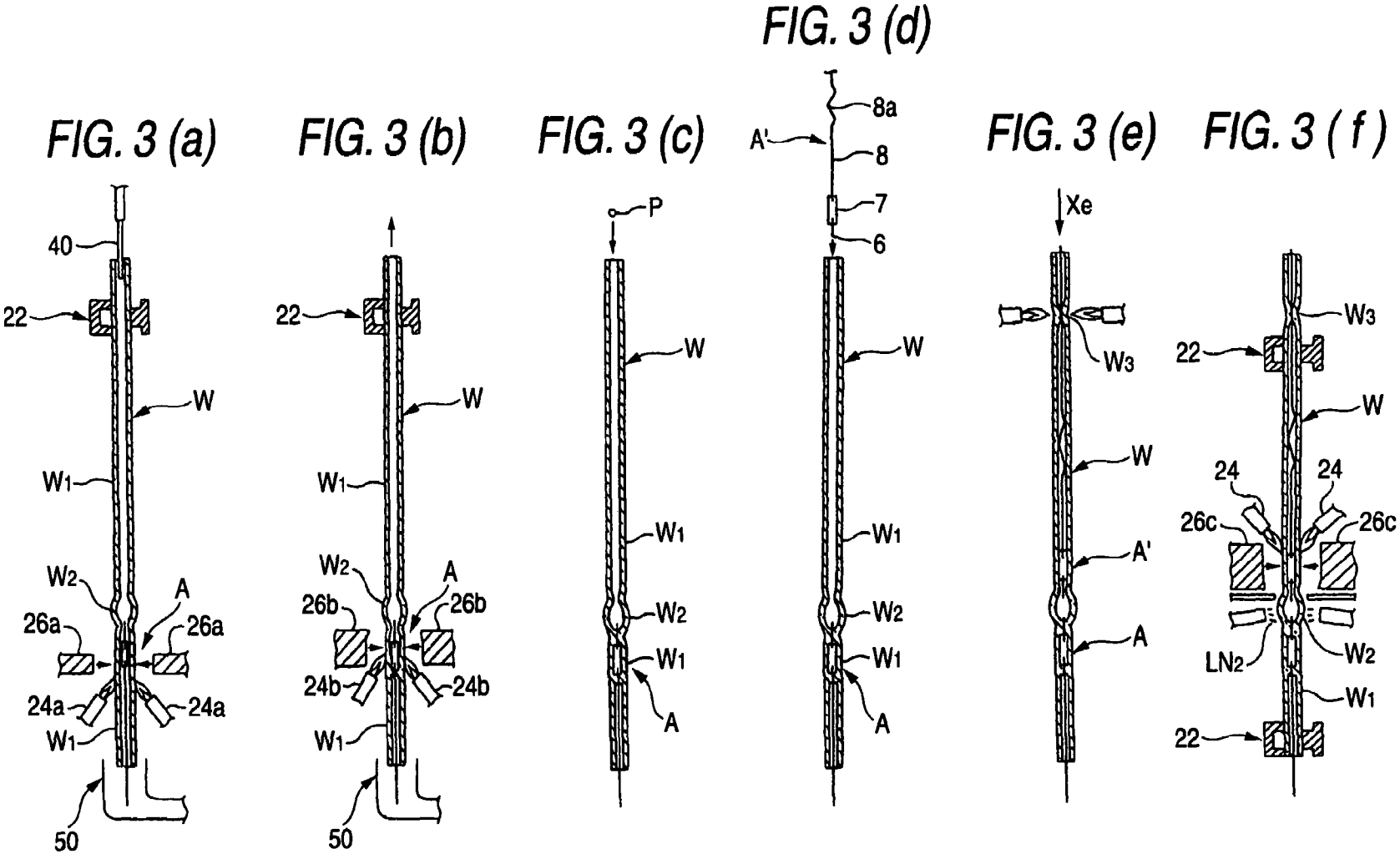
FIG. 3(*a*) is an explanatory view of a provisional pinch seal step in a primary pinch seal step.

FIGS. 1 to 6 show one embodiment of the invention. FIG. 1 is a longitudinal section of a mercury-free arc tube for discharge lamp in one embodiment of the invention; FIG. 2 is a process drawing that shows a pretreatment step in a manufacturing process of the arc tube; FIGS. 3(*a*) to 3(*f*) are process drawings that show the manufacturing process of the arc tube, in which FIG. 3(*a*) is an explanatory view of a provisional pinch seal step in a primary pinch seal step, FIG. 3(*b*) is an explanatory view of a normal pinch seal step in the primary pinch seal step, FIG. 3(*c*) is an explanatory view of putting-in of a pellet of a light emitting substance, FIG. 3(*d*) is an explanatory view of an insertion step of a second electrode assembly, FIG. 3(*e*) is an explanatory view of a tip-off step (temporarily electrode assembly fixing-step), and FIG. 3(*f*) is an explanatory view of a secondary pinch seal step; FIG. 4 is a diagram showing a result of a life measurement test of the arc tube; FIG. 5 is a diagram showing a result of a luminous flux measurement test of the arc tube; and FIG. 6 is a diagram showing a result of a starting voltage measurement test of the arc tube.

Figure 7:
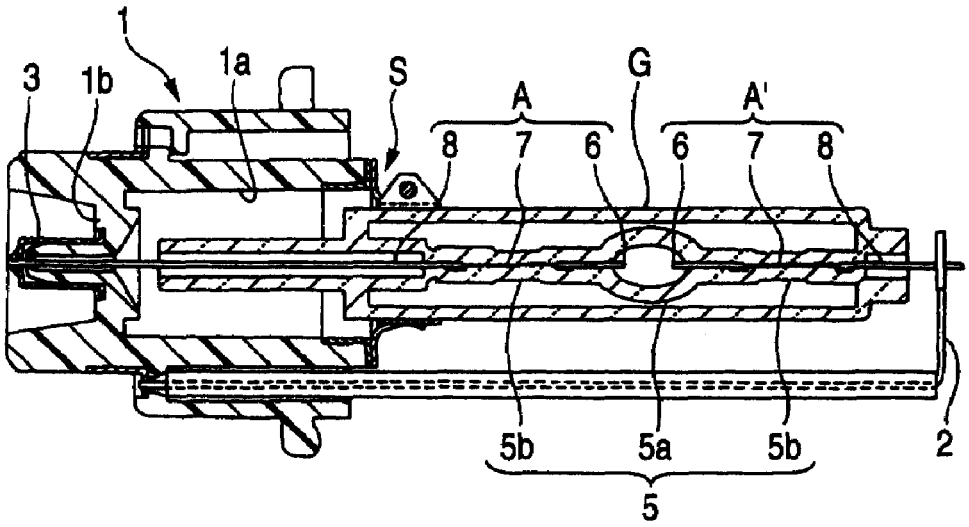
FIG. 7 RELATED ART
FIG. 7 is a longitudinal section of a discharge lamp of related art.
Figure 8:
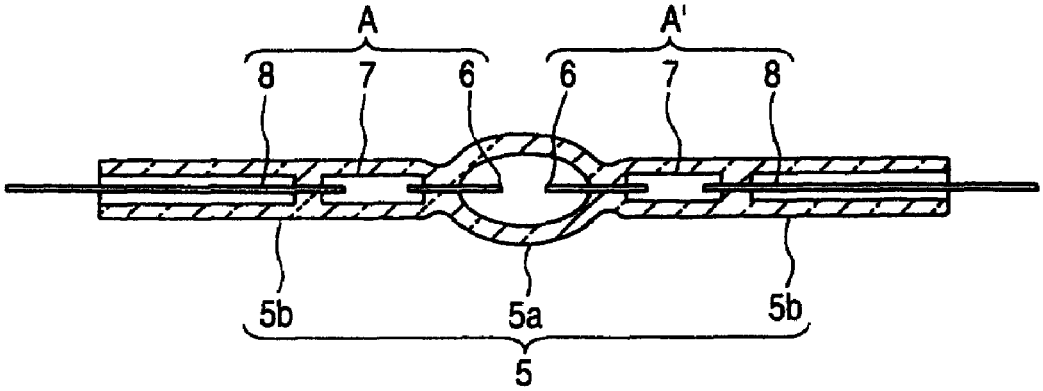
FIG. 8 RELATED ART
FIG. 8 is a longitudinal section of a mercury arc tube of related art.
Figure 9:
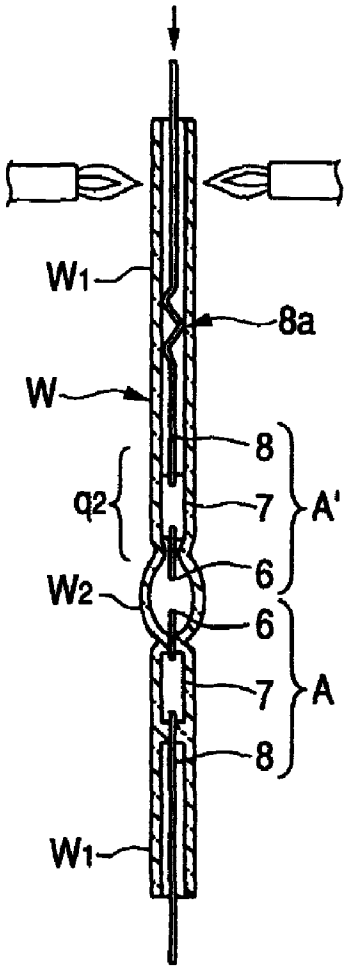
FIG. 9 (d) RELATED ART
FIG. 9(*a*) is an explanatory view for explaining a manufacturing process of a mercury arc tube of related art, in a primary pinch seal step.
Figure 9:
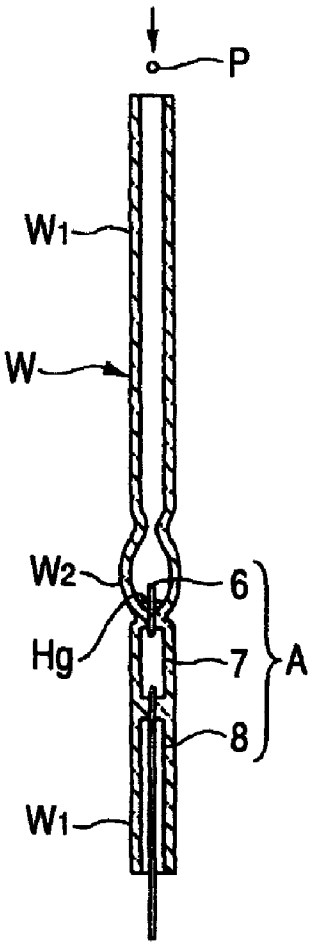
FIG. 9 (c) RELATED ART
Figure 9:
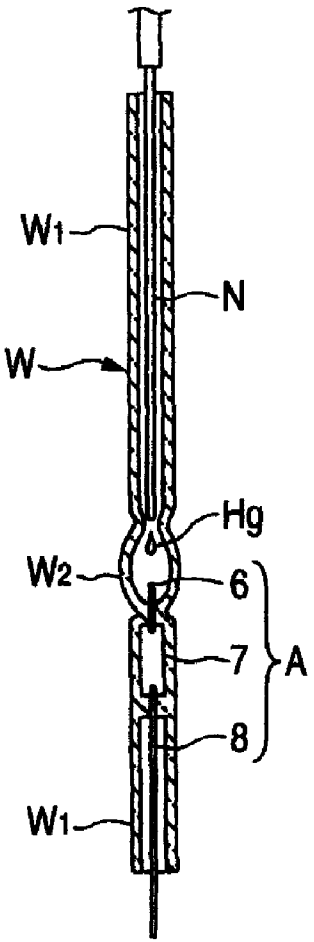
FIG. 9 (b) RELATED ART
Figure 9:
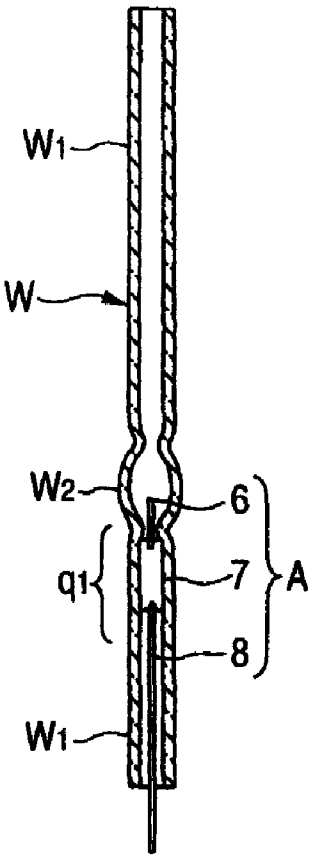
FIG. 9 (a) RELATED ART

In these drawings, since the discharge lamp to which an arc tube 10 is attached has a similar structure as the structure of FIG. 7, other than the arc tube, explanation of the structure is omitted.

The arc tube 10 is a silica glass tube W formed in the shape of a circular pipe. This tube 10 is so constructed that a spherical swollen portion w2 is formed midway in the longitudinal direction of a linear extension portion w1, spherical swollen portion w2 sides of the silica glass tube W are pinch-sealed, and pinch seal portions 13A, 13A' (primary pinch seal portion 13A, secondary pinch seal portion 13A') that are rectangular in cross section are formed at both end portions of an ellipsoidal tipless closed glass bulb 12 that forms discharge space. In the closed glass bulb 12, tungsten electrode rods 6, 6 constituting discharge electrodes are oppositely arranged. The electrode rods 6, 6 are connected to molybdenum foils 7, 7 sealed in the pinch seal portions 13A, 13A'. From ends of the pinch seal portions 13A, 13A', molybdenum lead wires 8, 8 connected to the molybdenum foils 7, 7 are led out, and the lead wires 8, 8 extend to the outside through circular pipe forming portions 14 that are non-pinch seal portions.

The exterior of this arc tube 10, at first view, is not different from that of the conventional arc tube 5 that encloses mercury. However, in the closed glass bulb 12, starting rare gas, metal halide for main light emission, and auxiliary metal halide (hereinafter referred to as a light emitting substance) working as a buffer substance in place of the mercury are enclosed. Namely, the arc tube 10 is different from the conventional arc tube enclosing the mercury that is a harmful substance to environment in that the auxiliary metal halide in place of the mercury is enclosed. Namely, the arc tube 10 is constituted as a mercury-free arc tube. Regarding the concrete constitution of the substance enclosed in the closed glass bulb 12, various proposals have been made in, for example, JP-A-11-238488 and JP-A-11-307048.

Next, a manufacturing process of the mercury-free arc tube 10 shown in FIG. 1 will be described with reference to FIGS. 2 to 3(*f*).

This manufacturing process of the mercury-free arc tube is characterized in that prior to steps of inserting electrode assemblies A, A' into the glass tube W and pinch-sealing the glass tube (refer to FIGS. 3(*a*) to 3(*f*)), a pretreatment step (refer to FIG. 2) of assembling the electrode assemblies A, A' and removing surely impurity (water and oxide film) from the electrode assemblies A, A' is performed.

Namely, it is natural that the electrode rod 6, the molybdenum foil 7, and the lead wire 8 that constitute the electrode assembly A, A' receive respectively, on parts level, impurity (water and oxide film) removing treatment. Further, also after these parts 6, 7 and 8 have been integrally joined as the electrode assembly A, A', the impurity (water and oxide film) removing treatment is applied to the electrode assembly A, A', and the impurity (water and oxide film) attached on the electrode assembly A, A' is surely removed. Thereafter, a primary pinch seal step shown in FIG. 3(*a*) is started.

Specifically, regarding the electrode rod 6, in a cutting step (a1) shown in FIG. 2, an elongated tungsten electrode material that is a component of the electrode rod is cut into an electrode rod 6 of the predetermined dimension (for example, 6.5 mm). Next, in a vacuum heat treatment step (b1) shown in FIG. 2, the electrode rod 6 of the predetermined dimension is put in a vacuum heating furnace to receive vacuum heat treatment (1600 to 2200° C.), whereby the impurity (water and oxide film) attached to the surface of the electrode rod 6 is removed. Particularly, since the vacuum heat treatment is performed at a high temperature of 1600 to 2200° C., not only the water and the oxide film attached to the surface of the electrode rod 6 but also impurity (water or foreign matter) inside the electrode rod 6 can be also removed.

Regarding the molybdenum foil 7, in an oxidation and reduction treatment step (b2), a spool-shaped molybdenum foil material (a strip-shaped molybdenum foil material having the width of 1.5 mm wound in the shape of a spool) is unwound, and receives the oxidation (300 to 500° C.) and reduction treatment (900° C.) in an oxidation and reduction furnace. Hereby, the surface roughness of the molybdenum foil material is heightened (unevenness of 1 μm and more is formed), air tightness with the vitreous layer is heightened, and the impurity (water and oxide film) attached to the surface of the molybdenum foil material is removed. This oxidation and reduction treatment of the molybdenum foil has been described in detail in JP-A-2003-086136. Next, in a cutting step (a2), the molybdenum foil material is cut into a molybdenum foil 7 of the predetermine dimension.

Regarding the molybdenum lead wire 8, in a cutting step (a3), an elongated molybdenum lead wire rod is cut into a lead wire 8 of the predetermined length. Thereafter, in a reduction treatment step (b3), the lead wire 8 is put in a reduction furnace to receive reduction treatment (800° C.), whereby the impurity (water and oxide film) attached to the surface of the molybdenum lead wire 8 is removed. Further, in the lead wire 8 corresponding to the electrode assembly A', after the cutting step, a bending portion 8*a* is formed in its predetermined position.

Thereafter, the electrode rod 6, the molybdenum foil 7, and the molybdenum lead wire 8 to which the treatment for removing the impurity (water and oxide film) has been applied on parts level are integrally formed as the electrode assembly A, A' by resistance welding in a welding-assembly step (c). Next, in a vacuum heat treatment step (d), the electrode assembly A, A' is put in a vacuum heating furnace to receive vacuum heat treatment at 200 to 800° C., whereby the electrode assembly A, A' from which the impurity (water and oxide film) has been surely removed is obtained. Further, in order to remove the impurity (water and oxide film) more surly, it is desirable that the electrode assembly A, A' receives the vacuum heat treatment while being washed by inert gas in which water concentration is adjusted to 1 ppm or less.

Next, the manufacturing process proceeds to steps (FIGS. 3(*a*) to 3(*f*)) of inserting the electrode assembly A, A' into the glass tube W and pinch-sealing the glass tube W. The glass tube W in which the spherical swollen portion w2 is formed midway of the linear extension portion is previously manufactured.

As shown in FIG. 3(*a*), the glass tube W is held perpendicularly, the electrode assembly A is inserted from the lower opening end side of the glass tube W and held in the predetermined position, and a foaming gas (argon gas) supply nozzle 40 is inserted into the upper opening end of the glass tube W. Further, the lower end portion of the glass tube W is inserted into a gas supply pipe 50. The foaming gas supplied from the nozzle 40 holds the inside of the glass tube W in the pinch-seal time in a preload state, and prevents the electrode assembly A from oxidizing. Inert gas (argon gas or nitrogen gas) supplied from the gas supply pipe 50 holds the lead wire 8 in inert gas atmosphere in the pinch seal time, and while the lead wire 8 is in a high temperature state after the pinch seal, thereby to prevent oxidation of the lead wire 8. Reference numeral 22 is a glass tube grip member.

While the heated foaming gas (for example, foaming gas heated at 120° C.) is supplied into the glass tube W from the nozzle 40, and the inert gas (argon gas or nitrogen gas) is supplied from the pipe 50 to the lower end portion of the glass tube W, the position near the spherical swollen portion w2 (position including the molybdenum foil 7) in the linear extension portion w1 is heated by a burner 24*a* at 2100° C., and the lead wire 8 connection side of the molybdenum foil 8 is provisionally pinch-sealed by a pincher 26*a*. Since the foaming gas supplied into the glass tube W has been heated, it removes effectively the water into the glass tube W.

Upon completion of the provisional pinch seal, as shown in FIG. 3(*b*), the inside of the glass tube W is held in a vacuum state (at pressure of 400 Torr or less) by a vacuum pump (not shown), and a non-pinch seal portion including the molybdenum foil 7 is heated by a burner 24*b* at 2100° C. to be really pinch-sealed by a pincher 26*b* (primary pinch seal step). Further it is desirable that degree of vacuum applied into the glass tube W is 400 Torr to $4\times10^{-3}$ Torr. Further, also in this real pinch seal step, it is desirable that the lower opening portion of the glass tube W is held in the inert gas (argon or nitrogen gas) atmosphere thereby to prevent the oxidation of the lead wire 8.

Next, into the glass tube W that has received the primary pinch seal treatment, as shown in FIG. 3(*c*), pellet P (spherical matter having the outer diameter of 0.5 mm) of a light emitting substance is put from the upper opening portion of the glass tube W into the spherical swollen portion (pellet putting-in step). Before putting the pellet P into glass tube W, washing is performed several times in order to fill the glass tube W with the inert gas. The inert gas (argon gas) used in this washing is heated at, for example, 120° C., whereby the water into the glass tube W is effectively removed.

Next, as shown in FIG. 3(*d*), from the upper opening end side of the glass tube W, the second electrode assembly A' is inserted to the predetermined position in the glass tube W (second electrode assembly inserting step).

For the lead wire 8 of this second electrode assembly A', an M-shaped bending part 8*a* is provided midway in the longitudinal direction. The bending part 8*a* is brought into pressure-contact with the inner surface of the glass tube W, whereby the electrode assembly A' is held by itself in the predetermined position in the longitudinal direction of the linear extension portion w1.

Next, after the insertion position of the second electrode assembly A' has been adjusted (generally, the assembly A' is inserted by several mm), the glass tube W is evacuated. As shown in FIG. 3(*e*), while xenon gas is supplied into the glass tube W, the predetermined upper portion of the glass tube W is tipped off, whereby the electrode assembly A' is provisionally fixed into the glass tube W, and the light emitting substance is sealed. Reference character w3 represents a tip-off portion.

After the tip-off step, (provisionally electrode assembly A' fixing step) shown in FIG. 3(*e*) as shown in FIG. 3(*f*), while the spherical swollen portion w2 is cooled by liquid nitrogen ($LN_2$) so that the light emitting substance P is not evaporated, the position near the spherical swollen portion w2 in the linear extension portion w1 (position including the molybdenum foil 7) is heated by a burner 24 at 2100° C. and secondarily pinch-sealed by a pincher 26*c*, and the spherical swollen portion w2 is sealed (secondary pinch seal step). Hereby, the glass tube can be finished, in which between the primary pinch seal portion 13A and the secondary pinch seal portion 13A', the glass tube forming the tipless closed glass bulb 12 into which the electrodes 6, 6 are oppositely arranged and the light emitting substance P is sealed is formed.

Lastly, by cutting the end of the glass tube W by the predetermined length, the mercury-free arc tube 10 shown in FIG. 1 is obtained.

FIGS. 4, 5 and 6 show results of a life measurement test, a luminous flux measurement test and a starting voltage measurement test of the arc tube 10 manufactured by the method in this embodiment (method shown in FIGS. 2 to 3(*f*)), compared with those of an arc tube in a comparative example (the mercury-free arc tube manufactured using the electrode assembly to which the impurity removing treatment after integration of the components of the electrode assembly is not applied though the impurity removing treatment is applied to each component of the electrode assembly, that is, the mercury-free arc tube manufactured using the electrode assembly that has received the pretreatment except the vacuum heat treatment step shown in FIG. 2D of the pretreatment process in FIG. 2). The arc tube in the embodiment has obtained good results in any tests.

FIG. 4 shows a result of the life test of the arc tube in a flashing mode determined in IEC 60810. In case that the electrode assembly A, A' receives the vacuum heat treatment at 200° C. and 800° C. (Embodiments 1 and 2), flicker does not occur even 3000 hours later. Further, in case that the electrode assembly A, A' receives the vacuum heat treatment at 1050° C., though the flicker does not occur even 3000 hours later, cracks due to foil lifting have occurred in the pinch seal portion 1000 hours later.

Namely, though the surface roughness (unevenness of 1 μm or more) of the molybdenum foil 7 is heightened by the oxidation (300-500° C.) reduction (900° C.) treatment step (b2) shown in FIG. 2, in case that the temperature of the vacuum heat treatment applied to the electrode assembly A, A' is 800° C. or more, molybdenum crystal particle enlarges (grows), the surface roughness of the molybdenum foil 7 is flattened, and air tightness with the vitreous silica lowers, so that foil lifting that causes leak of the sealed substance in the closed glass bulb 12 is produced.

On the other hand, in the comparative example, the flicker has occurred at 2560 to 2670 hours. Accordingly, though it is effective for prevention of the flicker occurrence to apply the vacuum heat treatment to the electrode assembly A, A' at 200° C. or more, in case that the vacuum heat treatment is performed at 800° C. or more, a new problem such as foil lifting is produced. Therefore, it is desirable that the vacuum heat treatment is performed in the range of 200 to 800° C.

Further, FIG. 5 shows a result when the arc tube has been lightened in an integrating sphere and a luminous flux has been measured (in the first characteristic measurement time) In case that the electrode assembly A, A' receive the vacuum heat treatment at 200° C. and 800° C. (Embodiments 1 and 2), luminous fluxes of 3081 lm and 3110 lm (average) that are more than 3000 lm that is a generally required standard as a luminous flux value of a light source bulb for automotive head lamp have been obtained. On the other hand, in the comparative example, the luminous flux is 2976 lm that is smaller than 3000 lm. In the embodiments, the luminous flux is larger than the luminous flux obtained in the comparative example by 100 lm or more, so that the embodiments are superior in lumen maintenance factor.

Further, FIG. 6 shows a result when the starting voltage has been measured using a ballast having pulse peak of 21 kV and rise time of 270 nsec (in the first characteristic measurement time). In case that the electrode assembly A, A' receives the vacuum heat treatment at 200° C. and 800° C. (Embodiments 1 and 2), the starting voltage (average) is about 15 kV (15.4 kV, 15.0 kV), which is lower than the starting voltage (18.9 kV) obtained in the comparative example by about 3.5 kV.

In the aforementioned embodiment, the foaming gas supplied into the glass tube in the primary pinch seal step is the heated gas. However, while the glass tube W is heated by a burner from the outside, the foaming gas that has not been heated may be supplied into the glass tube to remove the water in the glass tube W in the primary pinch seal step.

In the above description, washing into the glass tube W by the argon gas that is performed before the pellet putting-in step shown in FIG. 3(*c*) uses the heated argon gas. However, while the glass tube W is heated by a burner from the outside, the not-heated argon gas may be supplied to remove the water into the glass tube W in the washing time before the pellet putting-in step.

Further, in the embodiment, the mercury-free arc tube and the manufacturing method of the arc tube have been described. However, the invention can be similarly applied also to a mercury arc tube and a manufacturing method of the arc tube.

It will be apparent to those skilled in the art that various modifications and variations can be made to the described preferred embodiments of the present invention without departing from the spirit or scope of the invention. Thus, it is intended that the present invention cover all modifications and variations of this invention consistent with the scope of the appended claims and their equivalents.

What is claimed is:

1. An arc tube of discharge lamp comprising:

a closed glass bulb in a center of a glass tube, wherein a light emitting substance and a starting rare gas is enclosed in the closed glass bulb; and electrode assemblies formed by integrally joining an electrode rod, a molybdenum foil, and a molybdenum lead wire and sealed into pinch seal portions at both ends of the closed glass bulb so as to oppositely arrange electrodes in the closed glass bulb, wherein the electrode assembly receives vacuum heat treatment at 200 to 800° C. before being sealed into the pinch seal portions.

2. The arc tube of discharge lamp according to claim 1, wherein water contents of the electrode assemblies before being sealed into the pinch seal portions is 10 ppm or less.

3. The arc tube of discharge lamp according to claim 1, wherein water contents of the electrode assemblies before being sealed into the pinch seal portions is 3 ppm or less.

4. A method of manufacturing an arc tube of discharge lamp, the method comprising:

a primary pinch seal step of inserting a first electrode assembly from one end of a glass tube and pinch-sealing the glass tube, wherein the first electrode assembly is formed by integrally joining an electrode rod, a molybdenum foil, and a molybdenum lead wire;

a secondary pinch seal step of inserting a second electrode assembly from the other end of the glass tube and pinch-sealing the glass tube in a state where starting rare gas and a light emitting substance are supplied into the glass tube, wherein the second electrode assembly is formed by integrally joining an electrode rod, a molybdenum foil, and a molybdenum lead wire; and a step of applying a vacuum heat treatment to the first and second electrode assemblies at a temperature of 200 to 800° C., prior to the first and second pinch seal steps.

5. The method according to claim 4, further comprising:

a step of applying a vacuum heat treatment at a temperature of 1600 to 2200° C. to the electrode rod, prior to integrally forming the electrode assemblies.

6. The method according to claim 4, further comprising:

a step of applying an oxidation treatment at a temperature of 300 to 500° C. to the molybdenum foil; and a step of applying a reduction treatment at a temperature of 900° C. to the molybdenum foil applied the oxidation treatment, prior to integrally forming the electrode assemblies.

7. The method according to claim 4, further comprising:

a step of applying a reduction treatment at a temperature of 800° C. to the molybdenum lead wire, prior to integrally forming the electrode assemblies.

8. An arc tube of discharge lamp manufactured by steps of:

applying a vacuum heat treatment at a temperature of 1600 to 2200° C. to electrode rods;

applying an oxidation treatment at a temperature of 300 to 500° C. to molybdenum foils;

applying a reduction treatment at a temperature of 900° C. to the molybdenum foils after the oxidation treatment;

applying a reduction treatment at a temperature of 800° C. to molybdenum lead wires;

integrally joining the electrode rods, the molybdenum foils, and the molybdenum lead wires so as to form a first electrode assembly and a second electrode assembly;

applying a vacuum heat treatment at a temperature of 200 to 800° C. to the first and second electrode assemblies;

inserting the first electrode assembly from one end of a glass tube;

pinch-sealing the glass tube so as to seal the first electrode assembly;

supplying starting rare gas and a light emitting substance into the glass tube;

inserting the second electrode assembly from the other end of the glass tube; and pinch-sealing the glass tube so as to seal the second electrode assembly.

9. The arc tube of discharge lamp according to claim 1, wherein the arc tube is mercury-free.

* * * * *